US006302562B1

(12) United States Patent
Wu

(10) Patent No.: US 6,302,562 B1
(45) **Date of Patent: *Oct. 16, 2001**

(54) STRUCTURE FOR DECORATIVE LIGHTING STRING

(76) Inventor: Jeng-shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/478,734

(22) Filed: Jan. 6, 2000

(30) Foreign Application Priority Data

Jun. 3, 1998 (TW) ..... 99211984

(51) Int. Cl.[7] ..... F21S 13/14
(52) U.S. Cl. ..... 362/252; 362/249
(58) Field of Search ..... 362/249, 252, 362/396, 391, 806

(56) References Cited

U.S. PATENT DOCUMENTS

| | | | |
|---|---|---|---|
| 4,241,387 | 12/1980 | Bowers | 362/252 |
| 4,769,749 | 9/1988 | Felski | 362/250 |
| 5,057,976 | 10/1991 | DuMong | 362/123 |
| 5,213,409 | 5/1993 | Fisher | 362/252 |
| 5,662,409 | 9/1997 | Huang | 362/249 |
| 5,669,707 * | 9/1997 | Huang | 362/249 |
| 5,800,046 * | 9/1998 | Lin | 362/252 |
| 6,048,077 * | 4/2000 | Pan | 362/249 |
| 6,068,229 * | 5/2000 | Wang | 248/314 |
| 6,126,298 * | 10/2000 | Wu | 362/252 |

* cited by examiner

*Primary Examiner*—Alan Cariaso
*Assistant Examiner*—Hargobind S. Sawhney
(74) *Attorney, Agent, or Firm*—McGlew and Tuttle, P.C.

(57) ABSTRACT

The present invention is related to a kind of decorative lighting string structure comprising multiple lamp bulbs, multiple lamp bases or lamp holders and multiple electrical conductors, receptacles, flasher control and non-electrical connector, being connected in series, parallel or series and parallel to form a complete electrical circuit, said non-electrical connector and the electrical conductor of electrical circuit to be wound into twister, said bulb or lamp base or lamp holder being trapped into a proper place of twister formed between electrical conductor or non-electrical connector and fixed in the connecting place of lamp base and electrical conductor, said bulb and lamp base or lamp holder to be limited to a proper interval to combine into regular or irregular patterns of triangular, rhombic, rectangular or square units, said units being connected and arranged into a certain appearance, design or words and to obtain a decorative effect.

25 Claims, 13 Drawing Sheets

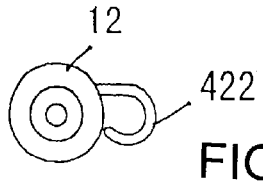
FIG 7C
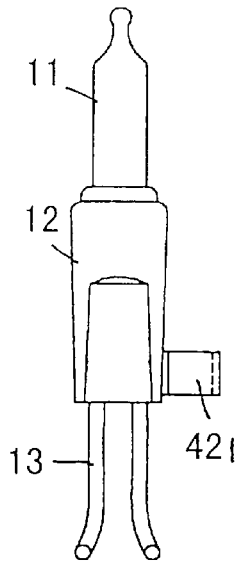
FIG 7A
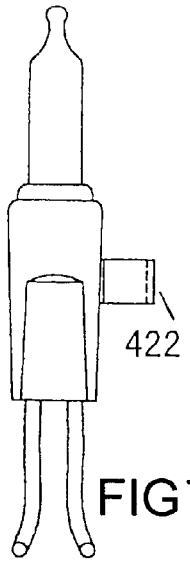
FIG7B
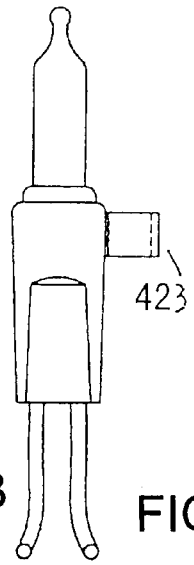
FIG 7D
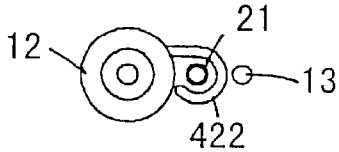
FIG 7H
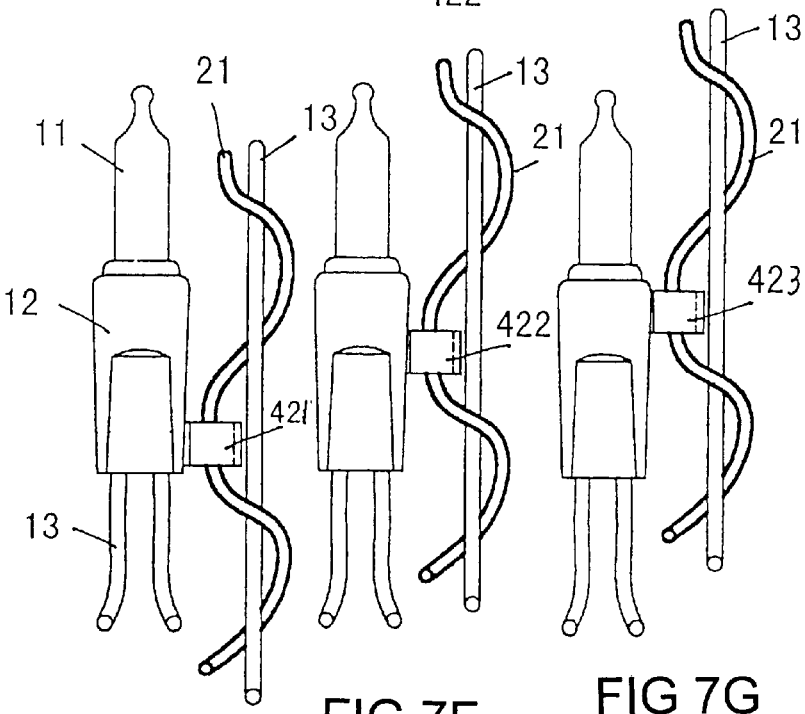
FIG 7E
FIG 7F
FIG 7G

STRUCTURE FOR DECORATIVE LIGHTING STRING

FIELD OF THE INVENTION

A conventional lamp socket device in a Christmas lighting string is consisting of lamp bulb, lamp base, lamp holder, multiple electrical conductors, receptacles or flasher control, wherein the electrical conductors can be single or double or more than two to wind into an electrical circuit. The contribution conductors can be formed in one, two or more than two electrical conductors, such as the FIG. 4 of U.S. Pat. No. 4,241,387. In general, it is to use said electrical conductors to be wound in the trees. Such is troublesome and monotonous. Further, such kind of work is used several years. The recent development is to form a net light. A conventional use is a lamp holder being equipped with a fastener or to use a fastening ring to fix the electrical conductors on the lamp holder; or to use fastening ring to bundle the multiple electrical conductors together, such as the structures found in U.S. Pat. Nos. 4,769,749; 5,057,976; 5,213,409; 5,662,409 and so on. However, such structures are still unable to reach an ideal effect. The present invention is an improvement in the defects of the conventional products. It is to use non-electrical connectors, in which their size, color and appearance similar to the electrical conductors, to be connected, wound and knotted with the electrical conductors and limited to the position of the lamp holders. Thus, it is able to form every appearance, design or words as to obtain a decorative effect.

SUMMARY OF THE INVENTION

One object of the present invention is to provide a kind of structure for a Christmas lighting string, by means of winding of electrical conductors and non-electrical connectors, to form various of patterns of decorative lighting strings.

Another object of the present invention is to provide a kind of structure for a Christmas lighting string, by means of winding electrical conductors and non-electrical connectors, to form various of patterns of desired words in decorative lighting strings.

A further object of the present invention is to provide a kind of structure for a Christmas lighting string, by means of winding electrical conductors and non-electrical connectors, to form various of colors of decorative lighting strings.

Another further object of the present invention is to provide a kind of structure for a Christmas lighting string, by means of winding electrical conductors and non-electrical connectors and fixing on the fixing apparatus, to form the position of decorative lighting strings to be fixed.

In order to substantially understand the above objects, features and effects of the present invention, the following detailed description wherein reference is made to the accompanying drawings.

BRIEF DESCRIPTION OF THE DRAWINGS

FIGS. 7A, 7B, 7C, 7D, 7E, 7F, 7G and 7H are embodiments of structures of Christmas lighting strings of various positions of linkers of a fixing apparatus on the waist part of lamp base or lamp holder of the present invention;

SYMBOL LISTS

Figure 1:
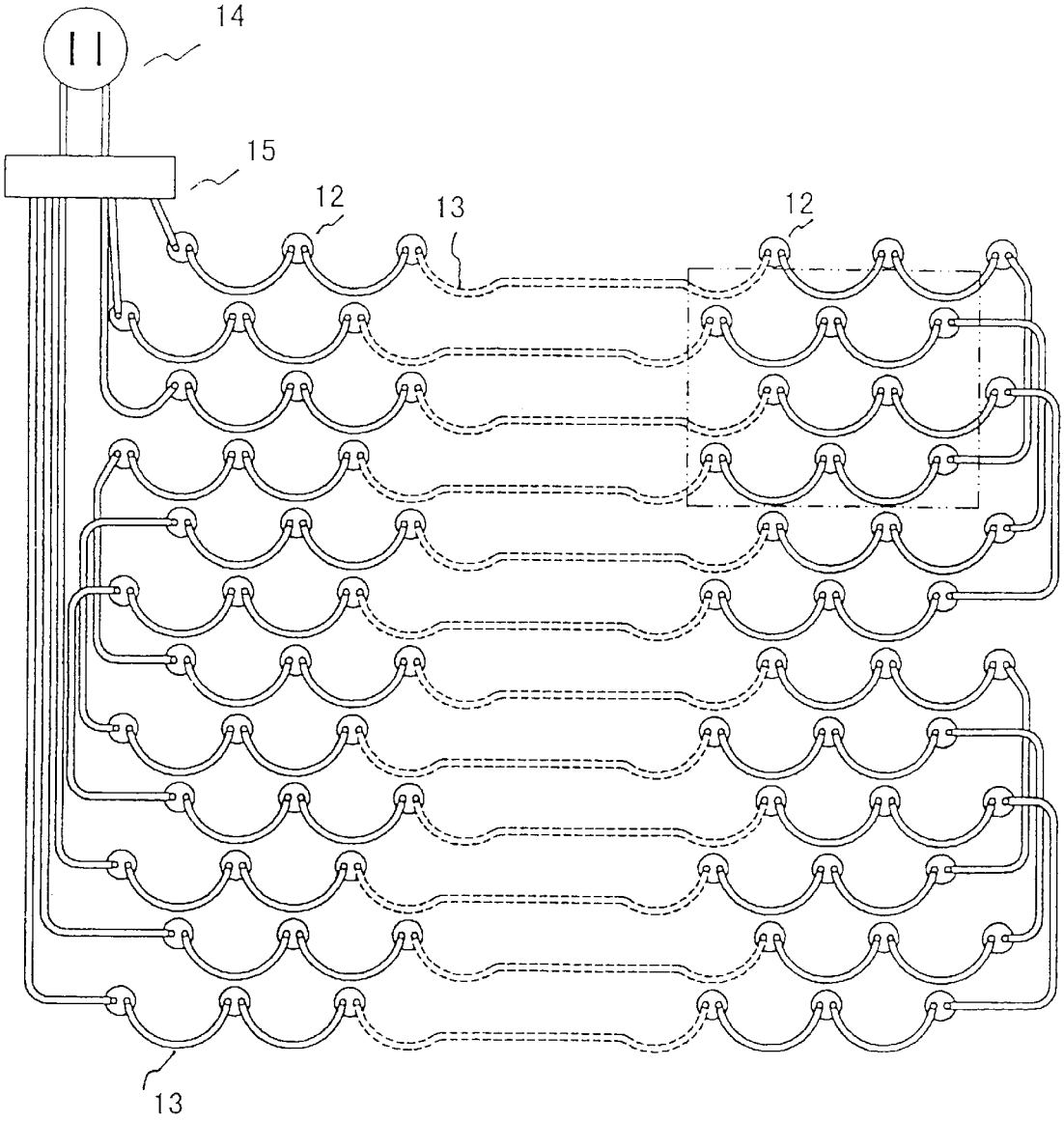
FIG. 1 is an embodiment of a structure of Christmas lighting strings with square patterns of the present invention.

11 lamp bulb
12 lamp base or lamp holder
121, 122, 123, 124, 125 lamp base or lamp bulb
13 electrical conductor
14 plug and/or connector
15 flasher control
21 non-electrical connector
211, 212, 213 non-electrical connector
31 triangular unit
32 rhombic, square or rectangular unit
33 round or irregular unit
40 fixing apparatus
41 linker (open end toward bulb)
42 linker (open end toward waist of lamp base)
421 near to the connected position of lamp base and electrical conductor
422 waist
423 near to bulb end

DETAILED DESCRIPTION OF THE PREFERRED EMBODIMENT

Referring to FIG. 1, it is showing an embodiment of a structure of Christmas lighting strings with square patterns of the present invention, in which a plug and/or connector 14 is connected to a flasher control 15, and a single electrical conductor 13 is connected in a series to several lamp bases or lamp holders 12 to become a complete electrical loop and to form a square pattern.

Figure 2:
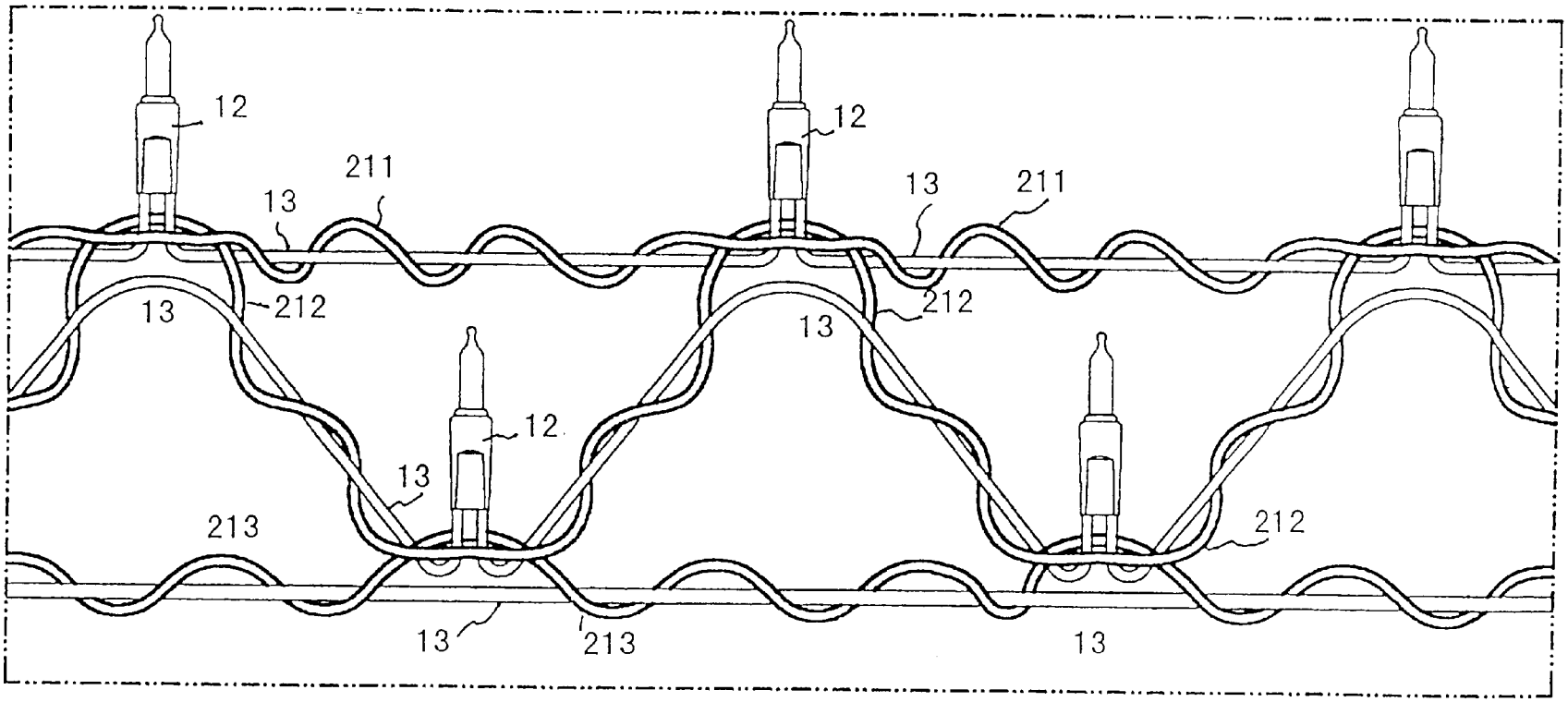
FIG. 2 is an embodiment of a unit of a structure of Christmas lighting strings with triangle patterns of the present invention.

FIG. 2 is an embodiment of a unit of a structure of Christmas lighting strings with triangle pattern, in which the lamp bases or lamp holders 121, 122, 123 are trapped between the electrical conductor 13 and non-electrical connectors 211, 212, 213 to form a triangle unit, wherein lamp base or lamp holder 121 being trapped between the electrical conductor 13 and non-electrical connector 211, then the non-electrical connector 211 to be tightly fixed on the non-electrical connector 212; the lamp base or lamp holder 122 is trapped between the electrical conductor 13 and non-electrical connector 212, then the non-electrical connector 211 to be tightly fixed on the non-electrical connector 212; the lamp base or lamp holder 123 is trapped between electrical conductor 13 and non-electrical connector 213, then the non-electrical connector 212 to be tightly fixed on the non-electrical connectors 213. Thus the lamp bases or lamp holders 121, 122 and 123 are to form a triangle unit.

Figure 3:
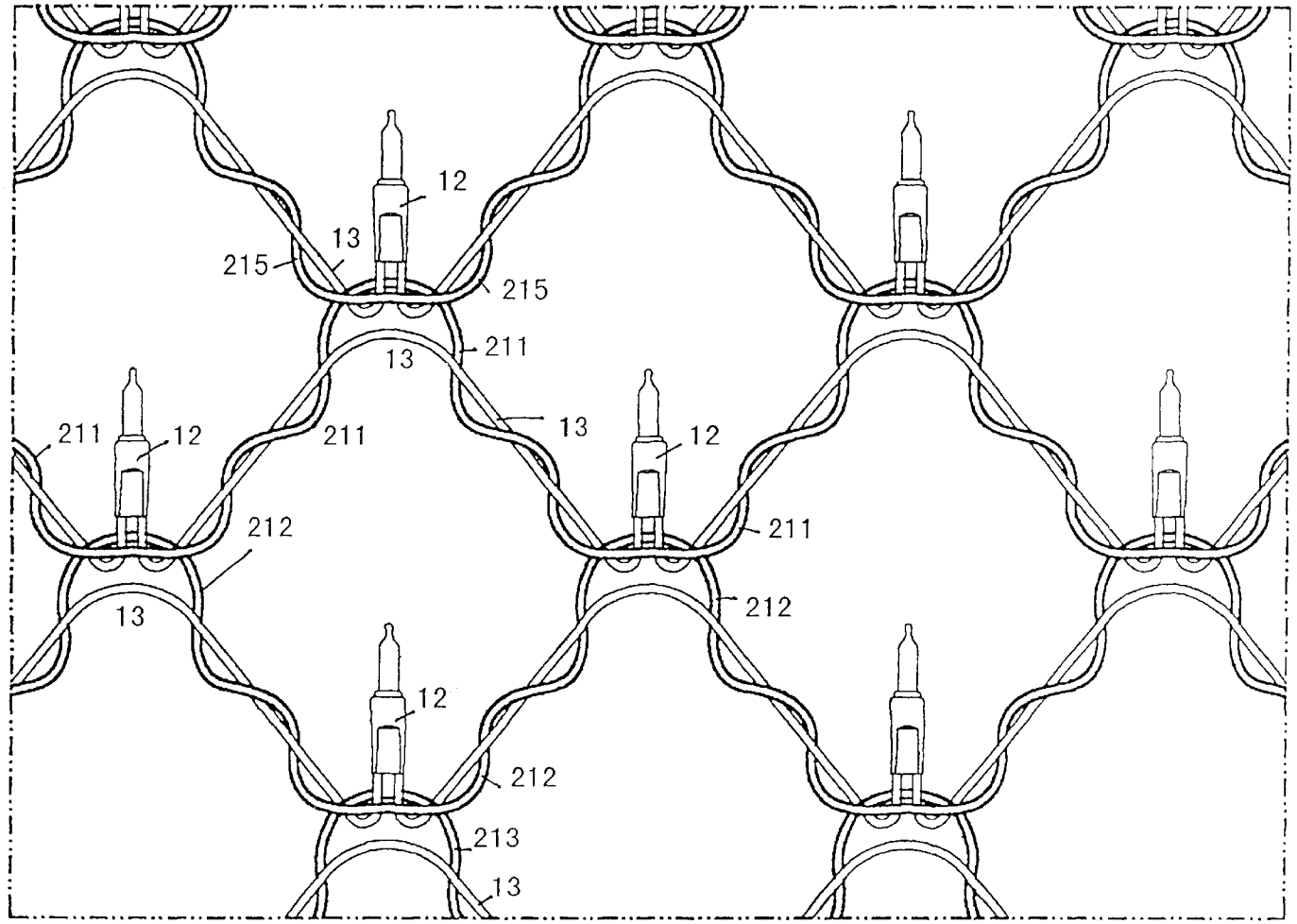
FIG. 3 is an embodiment of units of structures of Christmas lighting strings with triangle, square, rectangular patterns of the present invention.

FIG. 3 is an embodiment of units of structures of Christmas lighting strings with triangle, square, rectangular patterns; in which the lamp bases or lamp holders 121, 122, 123, 124 are trapped into the twister being formed by the electrical conductor 13 and non-electrical connectors 211, 212, 213, 215, wherein lamp base or lamp holder 121 are trapped into a place between the electrical conductor 13 and non-electrical connector 211, then the non-electrical connector 215 to be tightly fixed on the non-electrical connector 211; the lamp base or lamp holder 122 is trapped into a place between the electrical conductor 13 and non-electrical connector 212, then the non-electrical connector 211 to be tightly fixed on the non-electrical connector 212; the lamp base or lamp holder 123 is trapped into a place between electrical conductor 13 and non-electrical connector 213, then the non-electrical connector 212 to be tightly fixed on the non-electrical connector 213; the lamp base or lamp holder 124 is trapped into a place between electrical conductor 13 and non-electrical connector 212, then the non-electrical connector 211 to be tightly fixed on the non-electrical connector 212. Thus the lamp bases or base holders 121, 122, 123 and 124 are to form a rhombic, square or rectangular unit.

Figure 4:
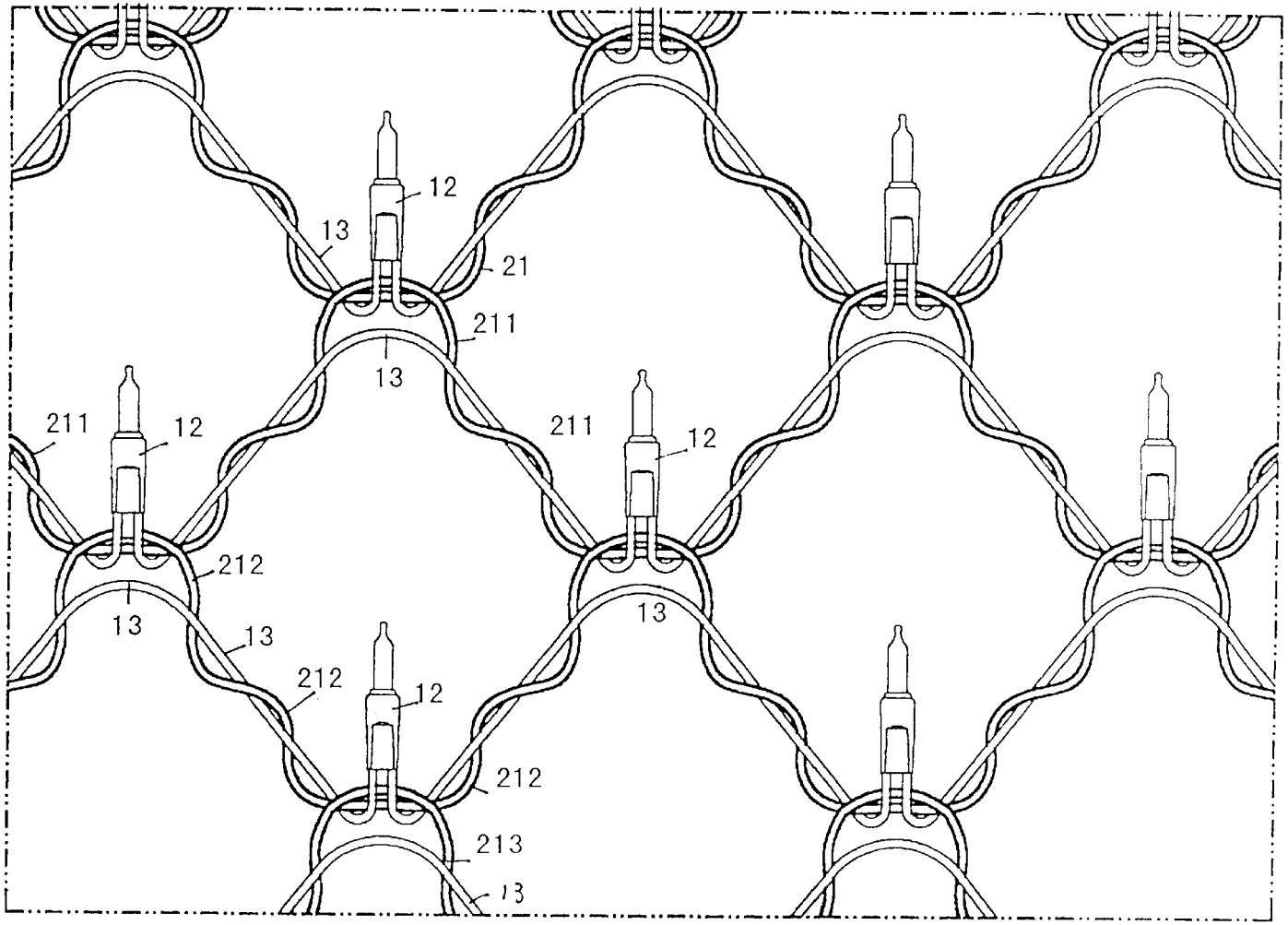
FIG. 4 is another embodiment of units of structures of Christmas lighting strings with triangle, square, rectangular patterns of the present invention.

FIG. 4 is another embodiment of units of structures of Christmas lighting strings with triangle, square, rectangular patterns, in which the lamp bases or lamp holders 121, 122, 123, 124 are trapped into the twister being formed by the electrical conductor 13 and non-electrical connectors 21, 211, 213, wherein lamp base or lamp holder 121 is trapped into a place between the electrical conductor 13 and non-electrical connector 211, then the non-electrical connector 21 to be tightly fixed on the non-electrical connector 211; the lamp base or lamp holder 122 is trapped into a place between the electrical conductor 13 and non-electrical connector 212, then the non-electrical connector 211 to be tightly fixed on the non-electrical connector 212; the lamp base or lamp holder 123 is trapped into a place between electrical conductor 13 and non-electrical connector 213, then the non-electrical connector 212 to be tightly fixed on the non-electrical connector 213; the lamp base or lamp holder 124 is trapped into a place between electrical conductor 13 and non-electrical connector 212, then the non-electrical connector 211 to be tightly fixed on the non-electrical connector 212. Thus the lamp bases or base holders 121, 122, 123 and 124 are to form a rhombic, square or rectangular unit.

Figure 5C:
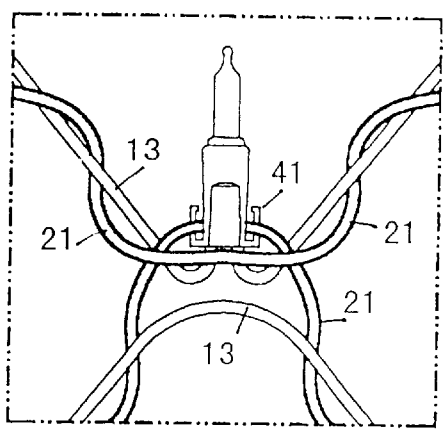
FIGS. 5A, 5B, 5C, 5D and 5E are embodiments of structures of Christmas lighting strings of linker's position of a fixing apparatus and fixing mode of non-electrical connector of the present invention.
Figure 5D:
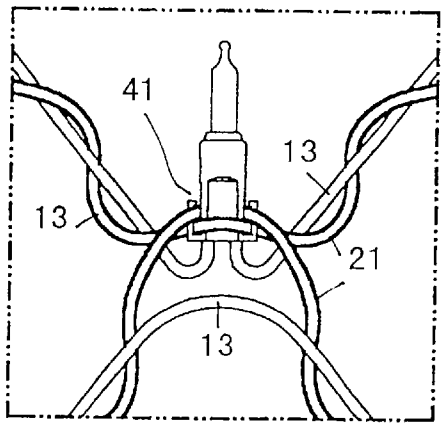
Figure 5E:
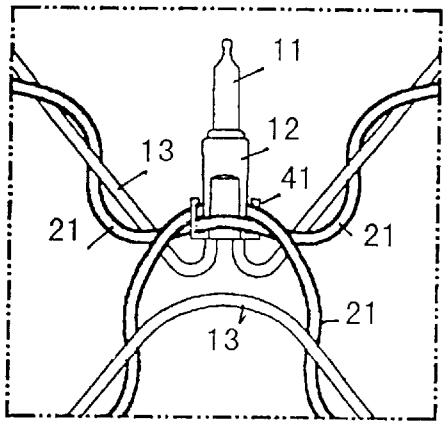
Figure 5A:
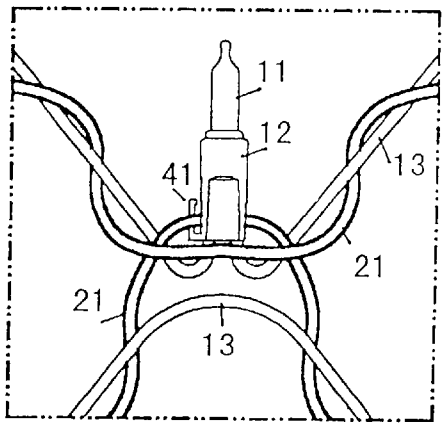
Figure 5B:
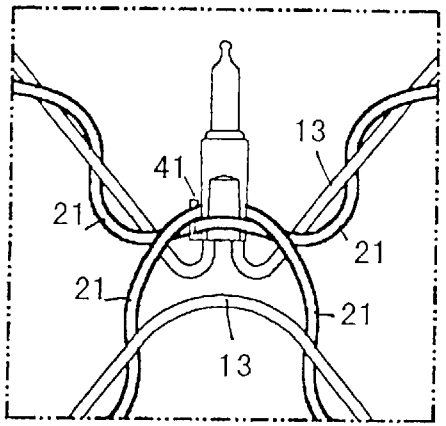

FIGS. 5A, 5B, 5C, 5D and 5E are embodiments of structures of Christmas lighting strings of linker's position of a fixing apparatus and fixing mode of non-electrical connector of the present invention; in which FIG. 5A has a fixing apparatus equipped on the base of the lamp holder 12, wherein the direction of open end of linker 41 is towards to bulb 11 and a single non-electrical connector 21 is fixed on the linker 41; FIG. 5B has a fixing apparatus equipped on the base of the lamp holder 12, wherein the direction of open end of linker 41 is towards to bulb 11 and two non-electrical connectors 21, 21 are fixed on the linker 41; FIG. 5C has a fixing apparatus equipped on the base of the lamp holder 12, wherein the both sides of lamp base equipped with linker 41 and the direction of open end of each linker 41 is towards to bulb 11 and a single non-electrical connector 21 is fixed on these two linkers 41, 41; FIG. 5D has a fixing apparatus equipped on the base of the lamp holder 12, wherein the both sides of lamp base equipped with linker 41 and the direction of open end of each linker 41 is towards to bulb 11 and two non-electrical connectors 21, 21 are fixed on these two linkers 41, 41; FIG. 5E has a fixing apparatus equipped on the base of the lamp holder 12, wherein the both sides of lamp base equipped with linker 41 and the direction of open end of each linker 41 is towards to bulb 11 and a single non-electrical connector 21 is fixed on these two linkers 41, 41, and two non-electrical connectors 21, 21 are fixed on these two linkers 41, 41.

Figure 6:
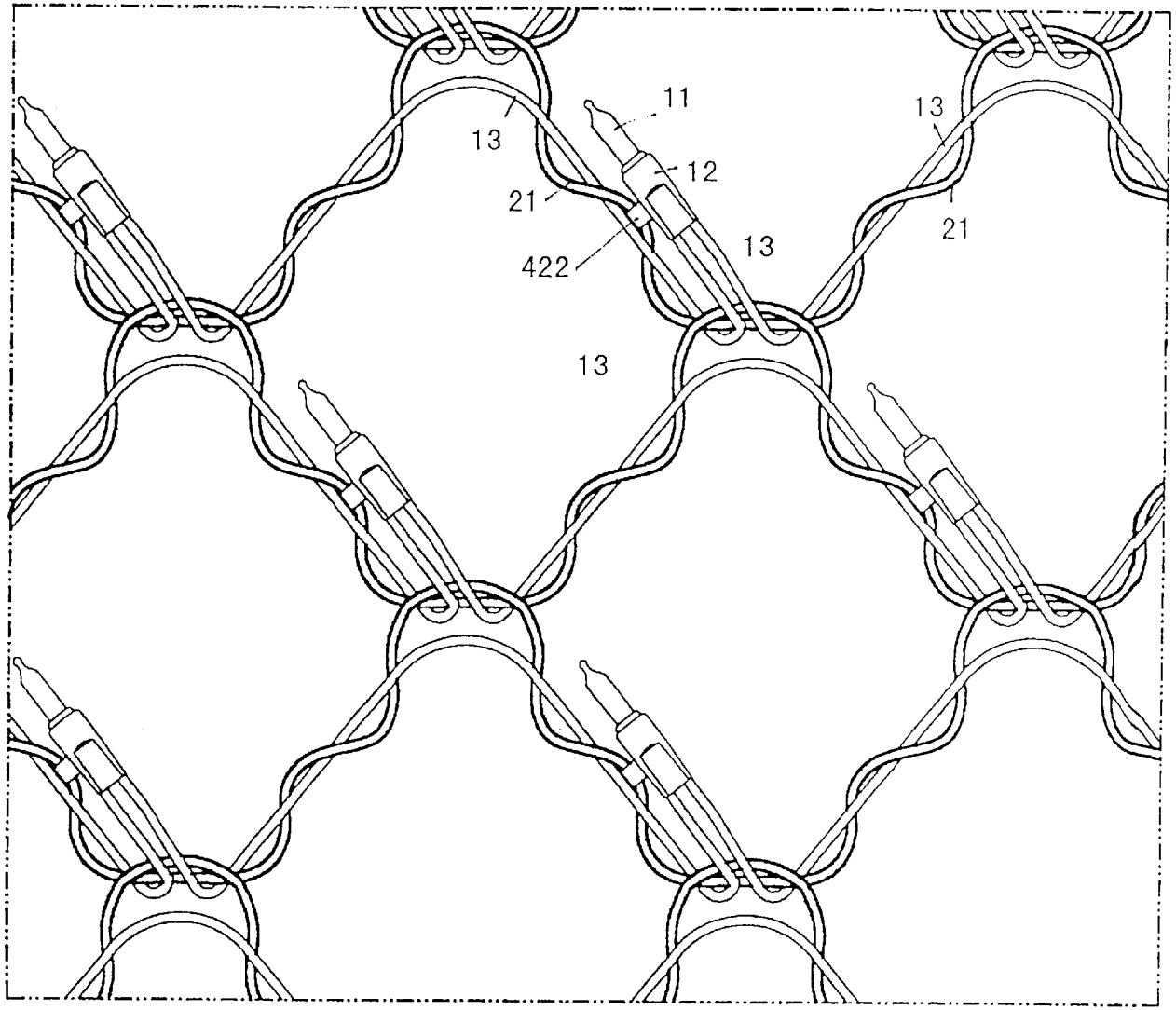
FIG. 6 is another embodiment showing a structure of Christmas lighting strings linker's position of a fixing apparatus of the present invention.

FIG. 6 is another embodiment showing a structure of Christmas lighting strings linker's position of a fixing apparatus; wherein a linker 422 is equipped on the waist of the lamp holder 12, the direction of open end of linker 41 is towards to waist of lamp holder and non-electrical connector 21 is fixed on the linker 422.

FIGS. 7A, 7B, 7C, 7D, 7E, 7F, 7G and 7H are embodiments of structures of Christmas lighting strings of various positions of linkers of a fixing apparatus on the waist part of lamp base or lamp holder of the present invention; wherein in FIG. 7A, a linker 421 of a fixing apparatus is equipped on the side position of the base of lamp holder 12, the direction of open end towards to the waist of lamp holder; in FIG. 7B, a linker 422 of a fixing apparatus is equipped on the side position of the waist of lamp holder 12, the direction of open end towards to the waist of lamp holder; in FIG. 7D, a linker 423 of a fixing apparatus is equipped on the upper position (i.e. near to bulb end) of lamp holder 12, the direction of open end towards to the waist of lamp holder; FIG. 7C is top view of FIGS. 7A, 7B and 7D, wherein the direction of the open end of the linker 422 being towards to the waist of lamp holder 12; FIGS. 7E, 7F and 7G are the non-electrical connector 21 is placed and fixed in the linkers 421, 422 and 423 individually; FIG. 7H is top side view of FIGS. 7E, 7F and 7G.

Figure 8:
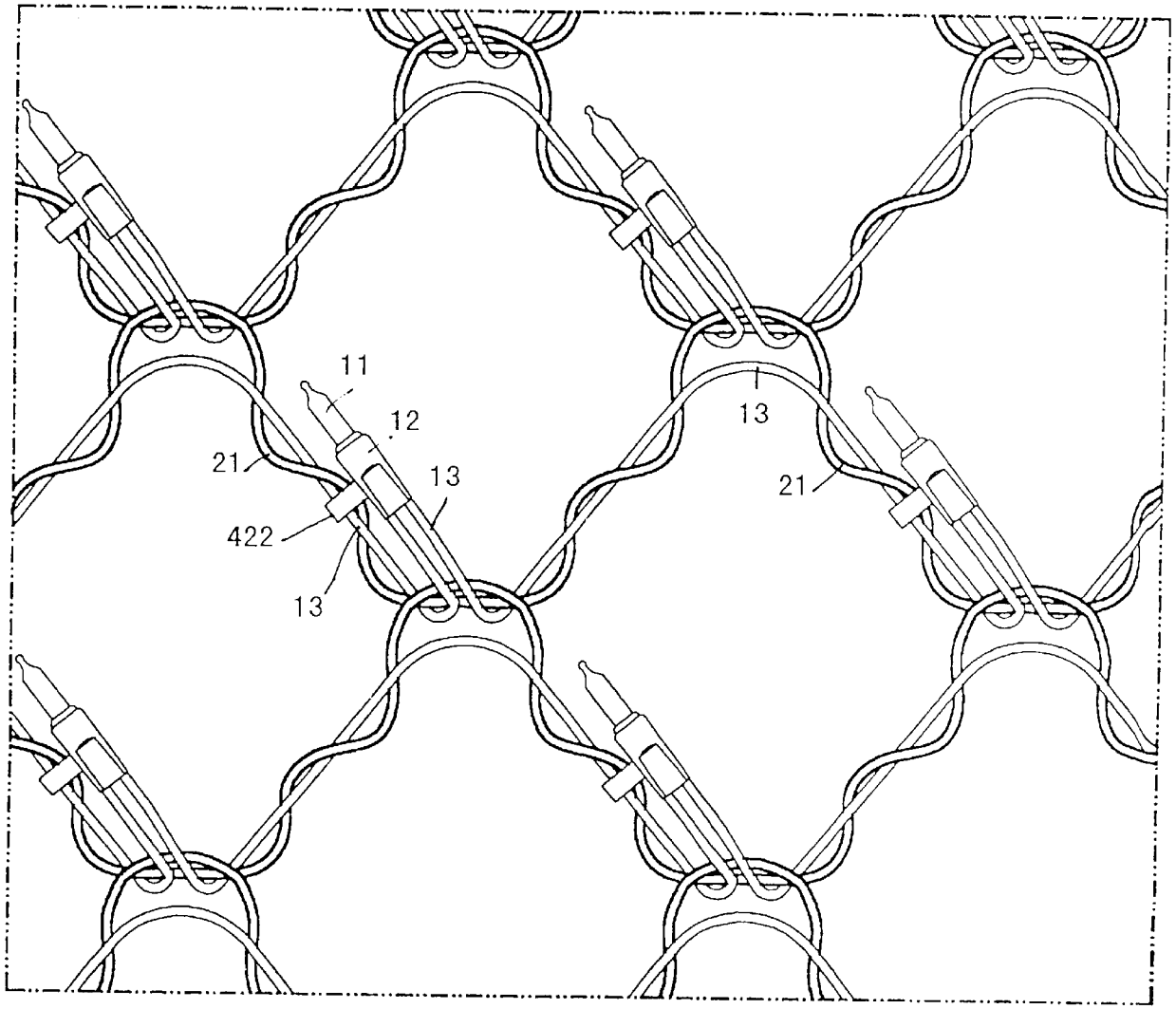
FIG. 8 is an embodiment of a structure of Christmas lighting strings of fixing mode of electrical conductor and non-electrical connector in the linker of a fixing apparatus of the present invention.

FIG. 8 is an embodiment of a structure of Christmas lighting strings of fixing mode of electrical conductor and non-electrical connector in the linker of a fixing apparatus; wherein a linker 422 is equipped on the waist of the lamp holder 12, the direction of open end of linker 41 is towards to waist of lamp holder, an electrical conductor 13 and non-electrical connector 21 are placed and fixed in the linker 422.

Figure 9C:
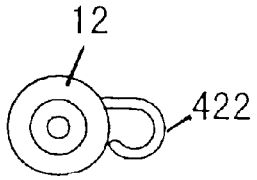
FIGS. 9A, 9B, 9C, 9D, 9E, 9F, 9G and 9H are embodiments of structures of Christmas lighting strings with various positions of linkers in fixing apparatus on the waist part of lamp base or lamp holder, and fixing mode of an electrical conductor and a non-electrical connector placed in the linker of the present invention.
Figure 9A:
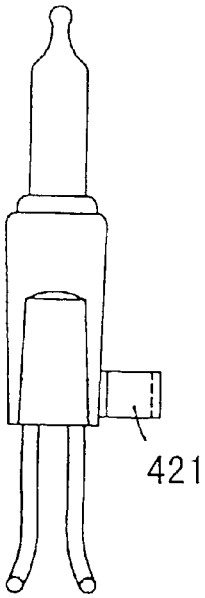
Figure 9B:
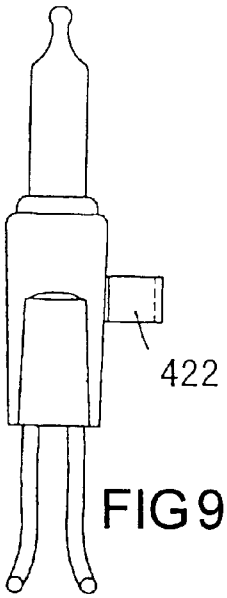
Figure 9D:
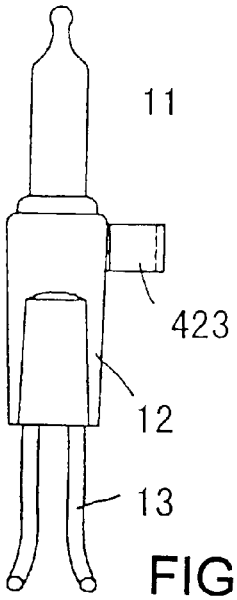
Figure 9H:
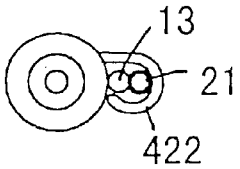
Figure 9E:
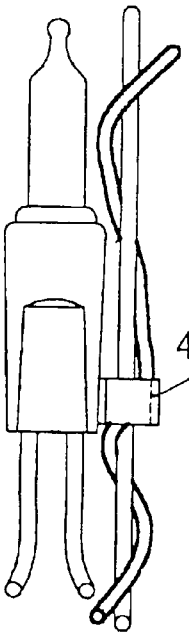
Figure 9F:
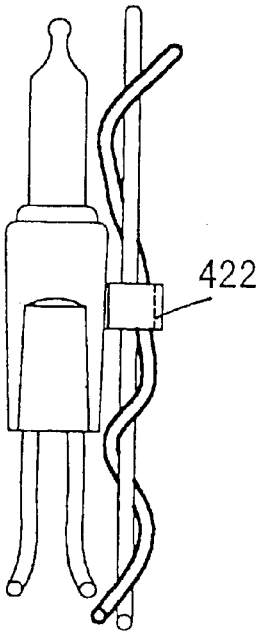
Figure 9G:
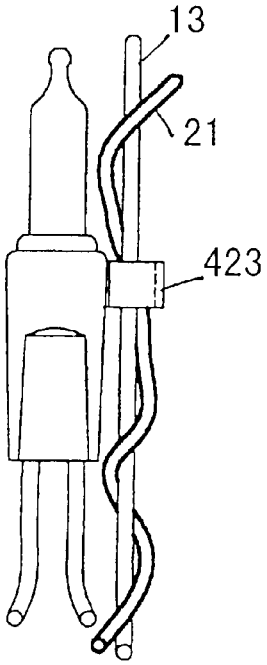

FIGS. 9A, 9B, 9C, 9D, 9E, 9F, 9G and 9H are embodiments of structures of Christmas lighting strings with various positions of linkers in fixing apparatus on the waist part of lamp base or lamp holder, and fixing mode of an electrical conductor and a non-electrical connector placed in the linker of the present invention; wherein in FIG. 9A, a linker 421 of a fixing apparatus is equipped on the side position of the base of lamp holder 12, the direction of open end towards to the waist of lamp holder; in FIG. 9B, a linker 422 of a fixing apparatus is equipped on the side position of the waist of lamp holder 12, the direction of open end towards to the waist of lamp holder; in FIG. 9D, a linker 423 of a fixing apparatus is equipped on the upper position (i.e. near to bulb end) of lamp holder 12, the direction of open end towards to the waist of lamp holder; FIG. 9C is top side view of FIGS. 9A, 9B and 9D, wherein the direction of the open end of the linker 422 being towards to the waist of lamp holder 12; FIGS. 9E, 9F and 9G are the non-electrical connector 21 is placed and fixed in the linkers 421, 422 and 423 individually; FIG. 9H is top side view of FIGS. 9E, 9F and 9G.

Figure 10C:
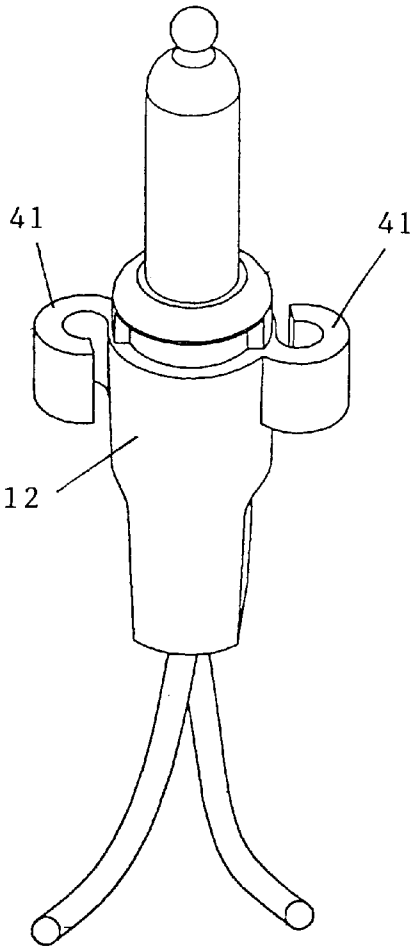
FIG. 10A, 10B and 10C are further embodiments of structures of Christmas lighting strings of linkers position of a fixing apparatus.
Figure 10B:
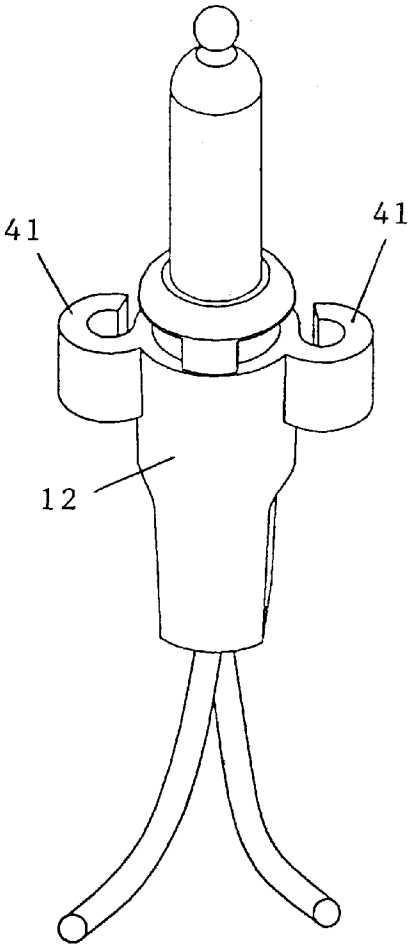
Figure 10A:
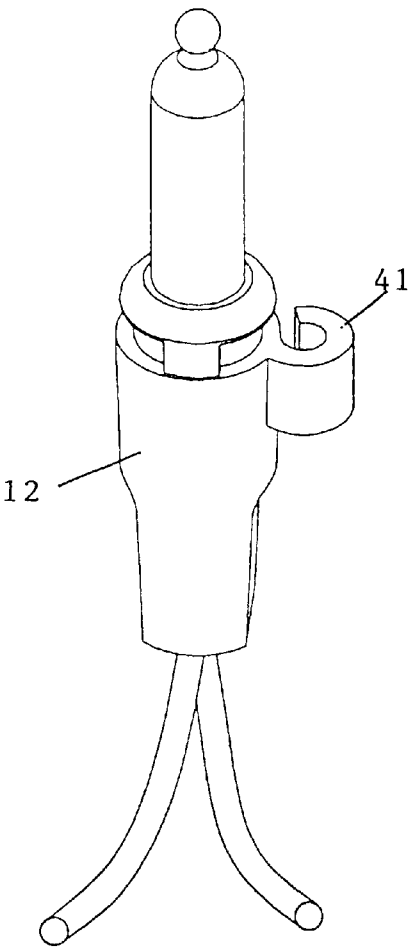

FIG. 10A, 10B and 10C are further embodiments of structures of Christmas lighting strings of linkers position of a fixing apparatus; in which FIG. 10A has a fixing apparatus equipped on the top of the lamp holder 12, wherein the direction of open end of linker 41 is towards to lamp holder 12 with horizontal open end; FIG. 10B has two fixing apparatus equipped on the top of the both sides of lamp holder 12, wherein the open end of both linkers 41 are towards to lamp holder 12 being the same direction; FIG. 10C has two fixing apparatus equipped on the top of the both sides of lamp holder 12, wherein the open end of both linkers 41 being the opposite direction.

Figure 11:
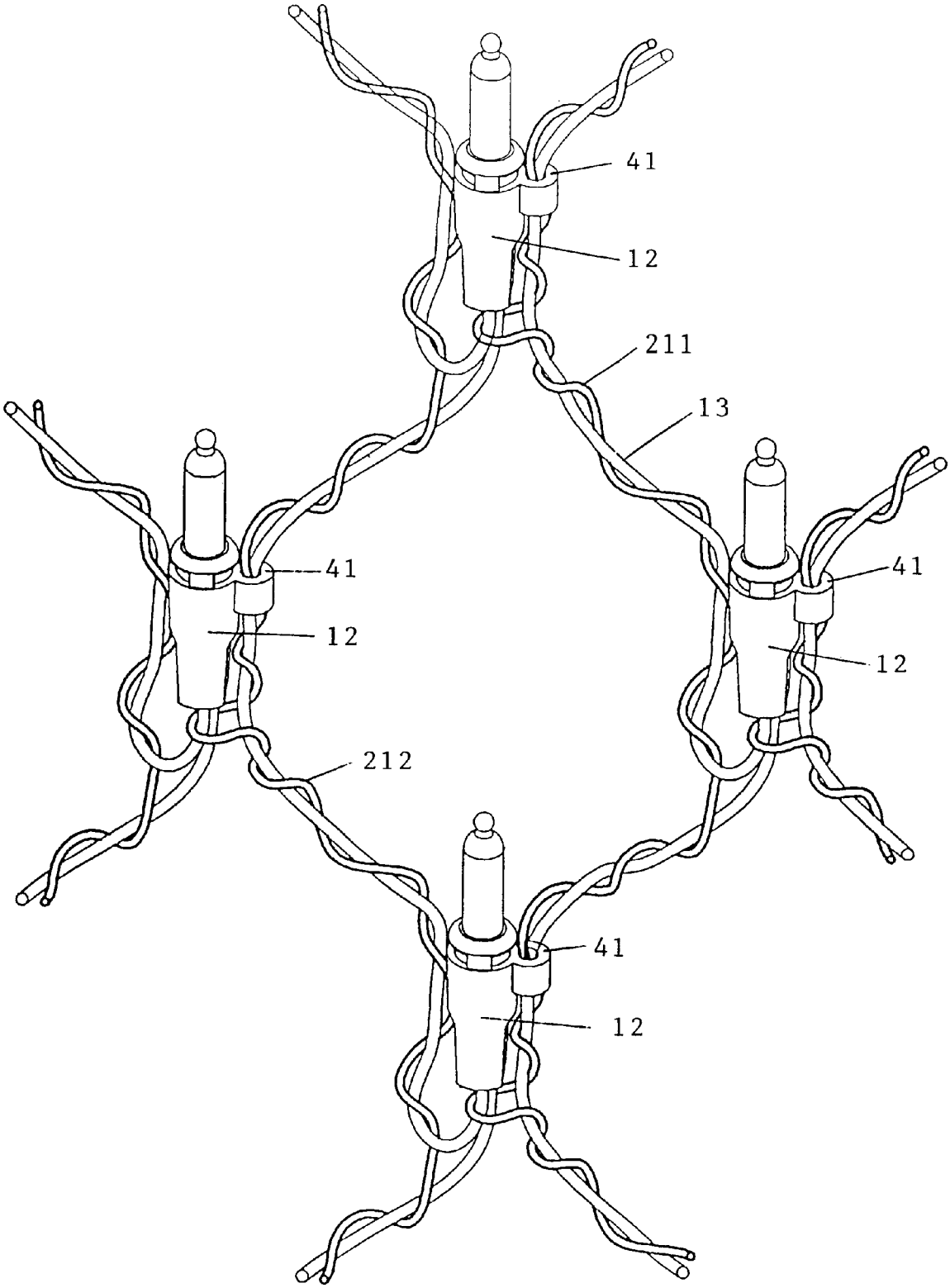
FIG. 11, FIG. 12, and FIG. 13 are further embodiment of a structure of Christmas lighting strings of fixing mode of electrical conductor and non-electrical connector in the linker of a fixing apparatus.
Figure 12:
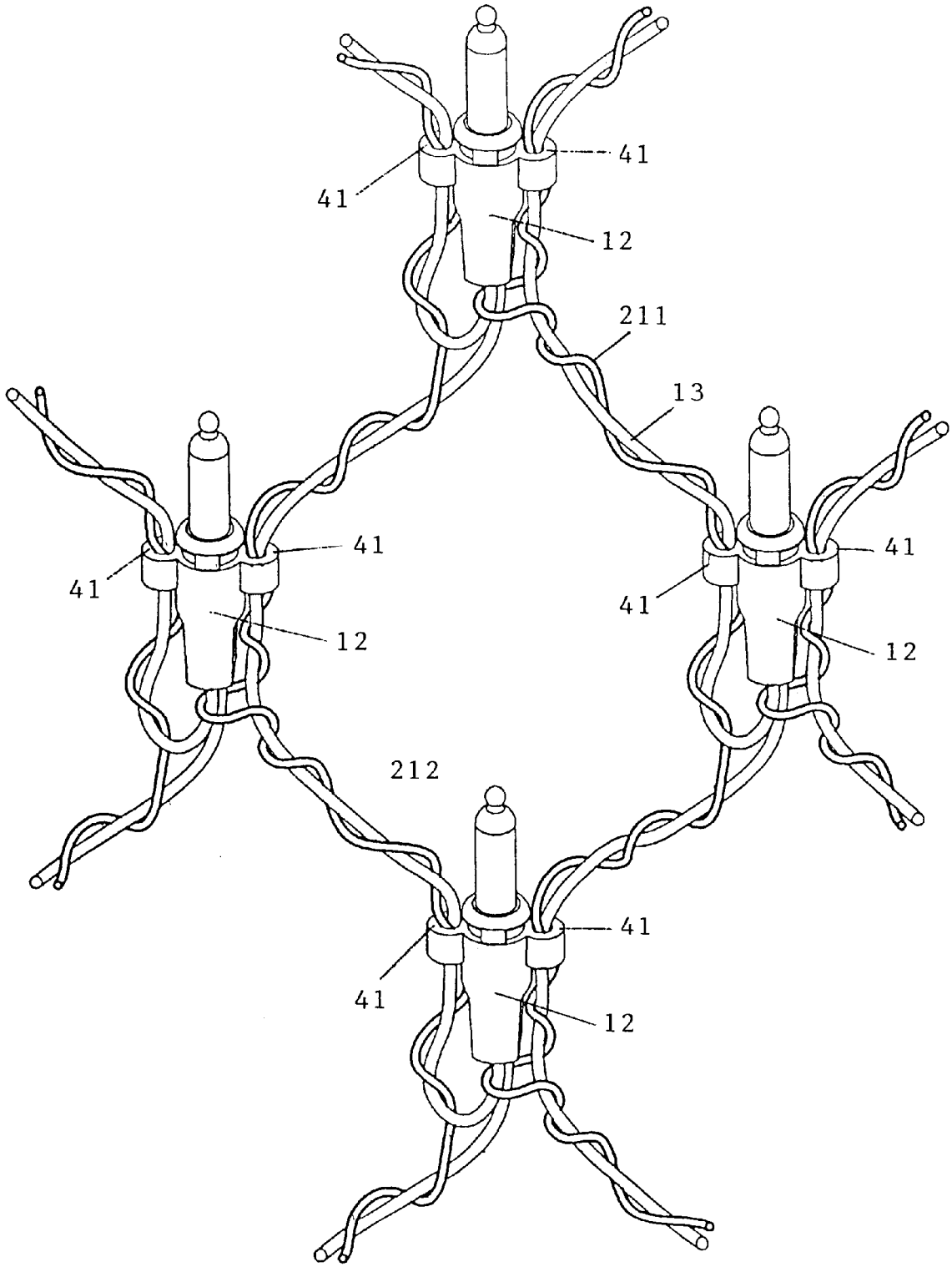
Figure 13:
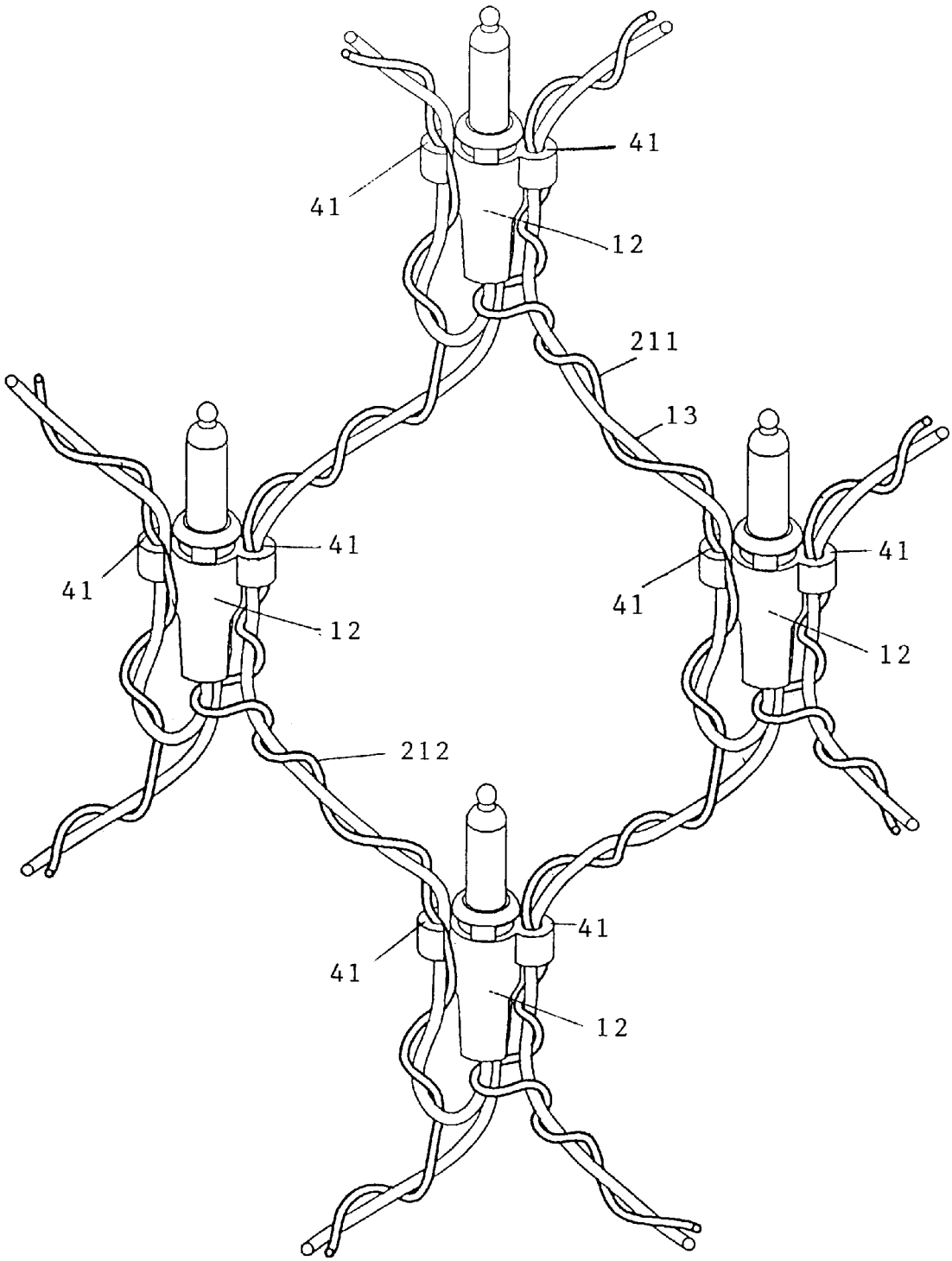

FIG. 11, FIG. 12, and FIG. 13 are further embodiment of a structure of Christmas lighting strings of fixing mode of electrical conductor and non-electrical connector in the linker 41 of a fixing apparatus; wherein in FIG. 11, a linker 41 is equipped on the top of the lamp holder 12; in FIG. 12 and FIG. 13, both linkers 41 are equipped on the top of the both sides of lamp holder 12, an electrical conductor 13 and a non-electrical connector 211 (or 212) placed in the linker (s) 41.

The features and preferred embodiments of the present invention have been described in the foregoing specification. It is really an invention with novelty and having practical values. The foregoing descriptions are only preferred embodiments of the present invention, and are not limited to the working range of the present invention; namely they do not depart from the equal alternations and modifications made by the claims of the present invention, and such alternations and modifications should still belong to the covering category of this invention.

What is claimed is:

1. A decorative lighting string structure comprising multiple lamps, multiple electrical conductors, and multiple non-electrical connectors connected to form an electrical circuit, one of said non-electrical connectors and said electrical conductors being wound into a twister, said lamps being trapped into a proper place of twister formed between said electrical conductors and said non-electrical connectors and fixed in the connecting place of the lamps and said electrical conductors, said lamps being limited to a proper interval to combine into patterns of one of triangular, rhombic, rectangular and square units, said units being connected and arranged into one of a certain appearance design and words, to obtain a decorative effect.

2. A decorative lighting string structure as claimed in claim 1, wherein said lamps are trapped into said twister to limit said bulb at proper intervals wherein one of, three said lamps are limited at proper intervals and connected to form a triangle unit, four said lamps are limited at proper intervals and connected to form one of a rhombic, square and rectangular unit, five or more said lamps are limited at proper intervals and connected to form a pattern, said patterns then being connected and arranged to form one of a certain appearance, design and words.

3. A decorative lighting string structure as claimed in claim 1, wherein said lamps are equipped with a fixing apparatus to tightly fix one of single and multiple said non-electrical connectors.

4. A decorative lighting string structure as claimed in claim 3, wherein the fixing apparatus has a linker with an open end and a direction of said open end being towards a bulb end of a respective said lamp, one of single and multiple non-electrical connectors placed and fixed tightly in said linker of said fixing apparatus.

5. A decorative lighting string structure as claimed in claim 4, wherein the linker on the lamps are near to the connection place of the lamps and electrical conductors for the convenience of fixing the non-electrical connectors.

6. A decorative lighting string structure as claimed in claim 3, wherein the fixing apparatus of the lamps have a linker with an open end and a direction of said open end is towards a bulb of the lamp, one of single and multiple non-electrical connectors, and electrical conductors one of individually and simultaneously, are placed and fixed tightly in said linker of said fixing apparatus.

7. A decorative lighting string structure as claimed in claim 6, wherein the linker on the lamps are near to one of a connection place, a waist and a bulb end of said lamps.

8. A decorative lighting string structure comprising multiple lamps, multiple electrical conductors, and a non-electrical connector, being connected to form an electrical circuit, said non-electrical connector and the electrical conductor of electrical circuit being wound into a twister, said lamps being trapped into a proper place of said twister formed between said electrical conductor and said non-electrical connector and fixed in a connecting place of the lamp and the electrical conductor, said lamps being limited to a proper interval wherein one of, three said lamps are limited at proper intervals and connected to form a triangle unit, four lamps are limited at proper intervals and connected to form one of a rhombic, square and rectangular unit, five or more lamps are limited at proper intervals and connected to form a pattern, with said patterns connected and arranged to form one of a certain appearance, design or words.

9. A decorative lighting string structure as claimed in claim 8, wherein fixing apparatus are connected to said lamps, said fixing apparatus having a linker near to the connecting place of said electrical conductor, one of single and multiple non-electrical connectors are placed and fixed tightly in said linker of said fixing apparatus.

10. A decorative lighting string structure comprising multiple lamps, multiple electrical conductors, and a non-electrical connector connected to form an electrical circuit, said non-electrical connector and the electrical conductor of electrical circuit are wound into a twister, said lamps being trapped into a proper place of said twister formed between the electrical conductor and the non-electrical connector and fixed in a connecting place of the lamps and the electrical conductor, said lamps being limited to a proper interval, three said lamps are limited at proper intervals and connected to form a unit, fixing apparatus connected to said lamps having a linker near to the connected place of the electrical conductor, one of single and multiple said non-electrical connectors placed and fixed tightly in said linker of said fixing apparatus; said units being connected and arranged into one of a certain appearance, design and words.

11. A decorative lighting string structure as claimed in claim 10, wherein said linkers have open ends facing in one of a longitudinal and radial direction of a respective said lamp, said non-electrical connector or electrical conductors one of individually and simultaneously placed and fixed tightly in said linker of said fixing apparatus.

12. A decorative lighting string structure as claimed in claim 10, wherein said linkers have an open end facing a respective said lamp, the linkers being placed on top of said lamps.

13. A decorative lighting string structure as claimed in claim 10, wherein two said linkers are connected to one of said lamps and define an open end facing a respective said lamp, said open end being in one of a same and opposite directions.

14. A light string arrangement comprising:

a first light string including a first lamp connected to first and second electrical conductors;

a second light string including a third electrical conductor with third and fourth lamps on ends of said third electrical conductor, a line twisted with said third electrical conductor, said first light string being arranged and held between said first line and said third electrical conductor.

15. An arrangement in accordance with claim 14, wherein:

said first and second electrical conductors of said first light string are arranged and held between said first line and said third electrical conductor.

16. An arrangement in accordance with claim 14, wherein:

said first lamp is positioned adjacent said first line and said third electrical conductor.

17. An arrangement in accordance with claim 14, wherein:

a linker is attached to said first lamp and defines an open end with said first lamp, one of said electrical conductors and said line being arranged between said linker and said first lamp.

18. A light string arrangement comprising:

a first light string, said first light string including a plurality of first string electrical conductors and a plurality of first string lamps in series;

a second light string including a plurality of second string lamps and a plurality of second string electrical conductors in series;

a line twisted with said second string electrical conductors, a plurality of portions of said first light string being arranged and held between said line and said second string electrical conductors.

19. An arrangement in accordance with claim 18, wherein:

each of said portions of said first light string include one of said first string lamps and parts of said first string electrical conductors adjacent said one of said first string lamps.

20. An arrangement in accordance with claim 18, wherein:

each of said portions of said first light string are arranged and held at different positions on said second light string;

said plurality of second string electrical conductors are arranged in series between said second string lamps.

21. An arrangement in accordance with claim 19, wherein:

each of said portions of said first light string are arranged and held at different positions on said second light string.

22. An arrangement in accordance with claim 18, wherein:

shaped portions of said first and second light strings are arranged between said portions of said first and second light strings which are held together, said shaped portions of said first light string being spaced from said shaped portions of said second light string.

23. An arrangement in accordance with claim 22, wherein:

said shaped portions form patterns of one of triangular, rhombic, rectangular and square shapes.

24. An arrangement in accordance with claim 18, wherein:

a linker is attached to said lamps and defines an open end with said lamps, one of said electrical conductors and said line being arranged between said linker and said lamps.

25. An arrangement in accordance with claim 18, further comprising:

a third light string including a plurality of third string electrical conductors and a plurality of third string lamps in series;

a third light string line twisted with said third string electrical conductors, a plurality of portions of said second light string being arranged and held between said third string line and said third string electrical conductors.

* * * * *